US005490670A

United States Patent [19]

Hobert

[11] Patent Number: 5,490,670

[45] Date of Patent: Feb. 13, 1996

[54] CRAPS LAYOUT ARRANGEMENT WITH JACKPOT WAGERING AREA AND RANDOMIZED JACKPOT SEQUENCES

[76] Inventor: Marcus V. Hobert, 3318 Kenwood Ave., Davenport, Iowa 52807

[21] Appl. No.: 389,537

[22] Filed: Feb. 16, 1995

Related U.S. Application Data

[63] Continuation-in-part of Ser. No. 305,178, Sep. 13, 1994.

[51] Int. Cl.[6] ..... A63F 3/00

[52] U.S. Cl. ..... 273/138 A; 273/309; 273/274

[58] Field of Search ..... 273/309, 246, 273/274, 138 A

[56] References Cited

U.S. PATENT DOCUMENTS

| | | | |
|---|---|---|---|
| 3,399,897 | 9/1968 | Mitchell | 273/146 |
| 3,904,208 | 9/1975 | Grossman | 273/146 |
| 4,334,685 | 6/1982 | Robbins et al. | 273/274 |
| 4,688,803 | 8/1987 | Ollington | 273/274 |
| 4,900,034 | 2/1990 | Bereuter | 273/274 |
| 4,902,019 | 2/1990 | Berman | 273/256 |
| 5,133,559 | 7/1992 | Page | 273/274 |
| 5,308,081 | 5/1994 | Bartle | 273/274 |
| 5,350,175 | 9/1994 | DiLullo et al. | 273/274 |
| 5,413,351 | 5/1995 | Franklin | 273/274 |

*Primary Examiner*—Benjamin H. Layno

*Attorney, Agent, or Firm*—McAndrews, Held & Malloy, Ltd.

[57] ABSTRACT

A gaming layout for the game of Craps having a jackpot box for receiving a wager that a set of randomly generated dice outcomes will be rolled. The set of randomly generated dice outcomes has a remote probability of occurrence and is selected from a predefined set of limited possible outcomes. A jackpot corresponds to a higher payoff than the payoffs associated with the ongoing possibilities of a conventional Craps game. The dice outcomes may be generated by a computer or by mechanical means. The dice outcomes to be matched and the corresponding tally of matches achieved are displayed for the bettors to observe.

42 Claims, 6 Drawing Sheets

CRAPS LAYOUT ARRANGEMENT WITH JACKPOT WAGERING AREA AND RANDOMIZED JACKPOT SEQUENCES

CROSS-REFERENCE TO RELATED APPLICATION

The present application is a continuation-in-part of the pending application of Marcus V. Hobert, U.S. Ser. No. 08/305,178 filed Sep. 13, 1994. The entire disclosure of this application, including the drawings and appendices, are incorporated herein by reference as if set forth fully in this application.

BACKGROUND OF THE INVENTION

The present invention relates to a gaming layout having a jackpot area and more particularly to a Craps gaming layout arrangement that permits the game of Craps to be played in a conventional manner while simultaneously introducing a jackpot into the game.

The magical allure of being able to "Hit The Jackpot" has always held special fascination for the populous as a whole. Typically, an extremely large payoff or jackpot is available as part of a basic wager so that the mere possibility of the jackpot is relied upon as a lodestone to attract consumer interest in such gaming devices as, for example, slot machines.

In states such as Nevada and New Jersey that have legalized gambling, competition among casinos and the like in attracting clientele to gaming establishments has always been quite fierce. Such competition has generally proceeded in terms of the magnificence of the establishment, incentives provided to patrons, and, to a limited extent, jackpots made available through specialized gaming devices such as slot machines or by special rules arranged to apply to a large number of simultaneous games, such as in tournaments. However, the ability to compete in terms of the magnificence of the establishment and incentives provided to patrons quickly becomes saturated due to practical considerations. Jackpots provided as the sole payoff on specialized gaming devices do not present an effective or a continued attraction to patrons. This occurs since regular patrons of such establishments will generally not continue to be attracted to a gaming device whose sole ability is to provide a jackpot since the odds associated therewith are inordinately high and these devices do not otherwise provide patron satisfaction.

Heretofore, the ability to inject the aura of a jackpot into conventional gaming equipment has been highly limited. This has resulted since conventional gaming arrangements cannot be provided with the possibility of winning a jackpot without a major modification of the game arrangement and in fact a changing of the way or rules by which the conventional game is played. This is objectionable since only traditional forms of gaming have wide appeal to patrons.

In addition, jackpot arrangements which occur as a result of conditions which are not related to dice outcomes have always been somewhat suspect and not well received by the public. For example, U.S. Pat. No. 4,902,019 issued to Berman discloses the use of jackpot areas in the game of Craps wherein the jackpot areas are defined by a geometric shape embossed on the Craps table. A jackpot condition is attained when a die rebounds off the dice table wall and lands completely inside the geometric shape. The question arises as to whether the player rolling the dice is playing craps or is rather attempting his skill at putting a die in the geometric shape. This destroys or changes the atmosphere of the conventional game of craps being played. Also, the jackpot condition involved in Berman does not depend on any additional wagering possibilities related to the various dice outcomes in the game of Craps.

One example of a known gaming layout arrangement for the game of Craps which not only includes the patron, but introduces a jackpot condition dependent of additional wagering is disclosed in U.S. Ser. No. 08/305,178 entitled "Craps Layout Arrangement Having Jackpot Area", filed on Sep. 13, 1994, and which is hereby incorporated by reference. This earlier application by this same inventor discloses a gaming layout for the game of Craps which includes a jackpot condition dependent on additional wagering events related to the various dice outcomes in the game of Craps. More particularly, the jackpot condition is attained when the shooter completes a series of predefined numbers or sums of numbers on the dice. The host of the game designates the series to be completed by the shooter in order to win the jackpot. Since the host has control over the choice of series, the patron is relegated to complete the series that the host designates with no variety or uncertainty. The host has the sole ability to selectively determine the series and therefore there is no change or suspense in the jackpot sequence.

A randomly generated jackpot sequence has additional appeal to patrons by introducing elements of variety, suspense, and chance into the definition of the winning jackpot sequence of outcomes. The patron may also perceive more fairness in the defined jackpot sequence as neither the host nor the patron controls the definition of the sequence which will win a jackpot.

SUMMARY OF THE INVENTION

Accordingly, it is an object of the present invention to provide a gaming layout arrangement for the game of Craps which includes a jackpot condition dependent on additional wagering events related to the various dice outcomes in the game of Craps.

It is a further object of this invention to provide a gaming layout arrangement for the game of Craps that permits the game to be played in the conventional manner while providing the additional availability of a jackpot without game interference.

An additional object of this invention is to provide a gaming layout arrangement for the game of Craps that permits a player to wager on jackpot possibilities corresponding to a high payoff.

A further object is to provide a gaming layout arrangement for the game of Craps including a jackpot wherein the jackpot condition is attained by matching a series of outcomes and this series is defined by a random selection mechanism.

The foregoing objects and advantages are accomplished by a gaming layout for the game of Craps having a jackpot box for receiving a wager that the shooter will be able to match a series of dice roll outcomes randomly designated by a mechanism. The set of outcomes has a remote probability of occurrence. A jackpot corresponds to a higher payoff than the payoffs associated with the ongoing possibilities of a conventional Craps game.

Other objects and advantages of the present invention will become apparent from the following more detailed description, which, in conjunction with the accompanying drawings, illustrates, by way of example, the principles of the invention.

BRIEF DESCRIPTION OF THE DRAWINGS

The preferred embodiment of the present invention is shown in the attached drawings, in which.

DETAILED DESCRIPTION OF THE INVENTION

Figure 1:
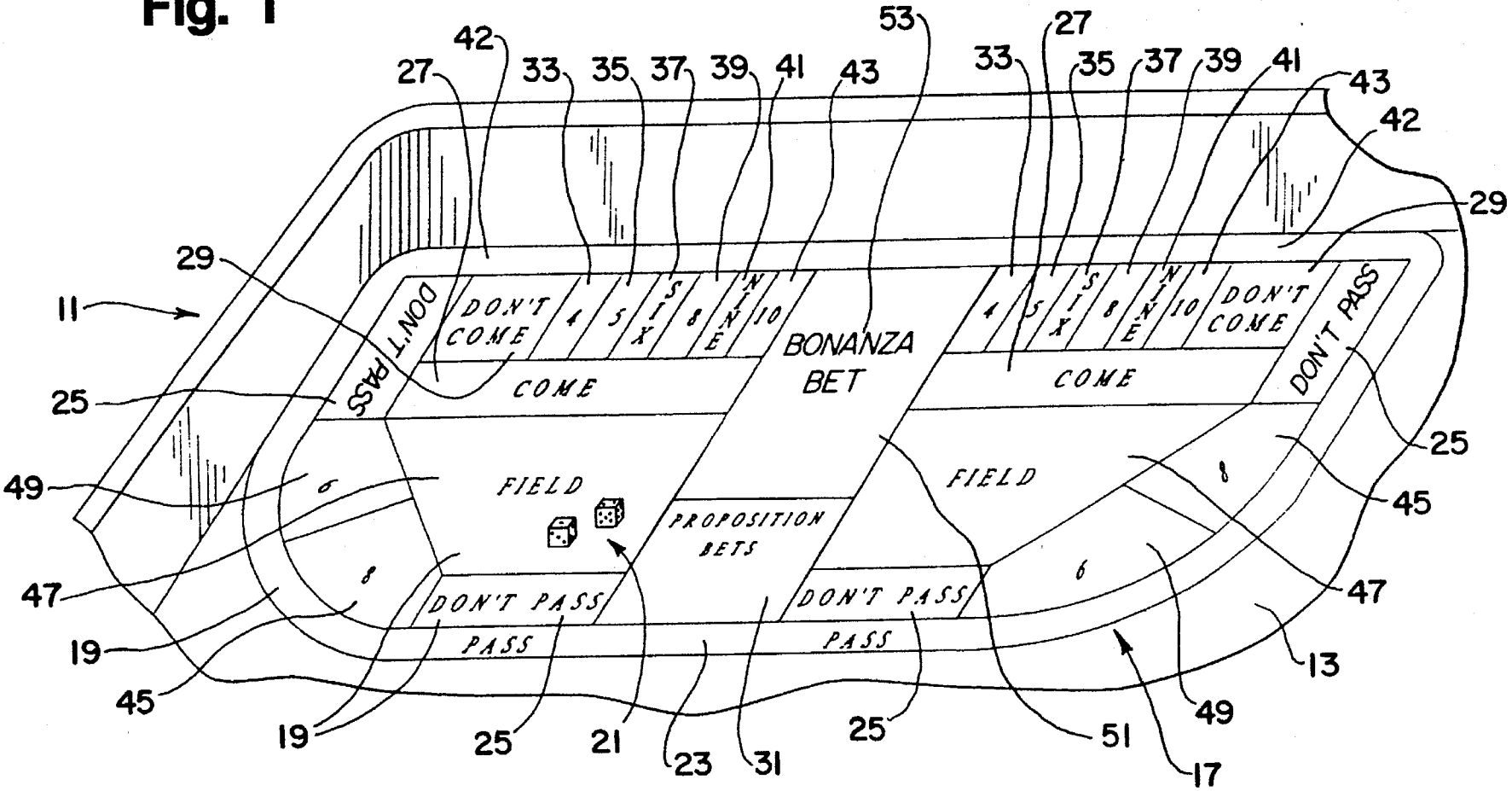
FIG. 1 is a perspective view of an embodiment of a Craps gaming layout arrangement having a Craps jackpot wagering area.

Referring to FIG. 1, the game of Craps is played on a gaming structure 11 which includes a flat table surface 13 and a side wall 15 that circumscribes fully or partially flat surface 13. A craps layout 17 is printed on flat surface 13 to provide a plurality of separate wager areas 19.

A single player, known as a shooter, rolls dice 21 (two die are rolled simultaneously) in order to determine the win/lose outcome of wagers placed on Craps layout 17. The wagers may be placed by the shooter and any number of other players. The wagers are placed by a player positioning chips or money within any one of a number of wager areas 19. On some occasions, a player may hand the chips to a dealer and tell the dealer what wager the player wishes to make.

The outcome of the roll of dice 21 is based on the sum of the spots on the two sides of the dice which face up when the dice come to rest. The shooter rolls the dice on flat surface 13 and the dice may hit against side wall 15 before coming to rest. The outcome of the roll of the dice is compared to the wagers to determine the win/lose of each wager. Some wagers require a number of rolls of the dice, whereas other wagers are made with respect to the next roll.

The game is organized with three different groupings of outcome numbers: the naturals (7 and 11), the craps (2, 3, and 12), and the point numbers (4, 5, 6, 8, 9, and 10).

The play of a game begins with an initial dice roll by the shooter. This initial roll is called the "come out roll." The shooter will repeatedly roll the dice until a point number is rolled. Once the point number is determined, the shooter will continue to roll the dice until that point number is rolled once again or a 7 is rolled.

The players, including the shooter, may place wagers betting that the point number will be rolled before the 7 is rolled by placing a wager within the "pass line" area 23. As shown in FIG. 1, a label comprising the word "PASS" is printed within area 23 to identify the wager area type. The players may also place wagers betting that the 7 will be rolled before the point number is rolled by placing a wager within the "DON'T PASS" area 25. As shown in FIG. 1, there are four "don't pass" areas 25. A label comprising the words "DON'T PASS" is printed within each area 25 to identify the wager area type.

The PASS area 23 and the DON'T PASS areas 25 are also used for wagers during the come out roll prior to the point number being established by the shooter. Until a point number is established, the pass line wager is a bet that the shooter will roll a natural before a point number or before craps is rolled. Also, until a point number is established, the "don't pass" wager is a bet that the shooter will roll craps before a point number or before a natural is rolled, except that a roll of 2 or 12, as predetermined by the host of the game, is treated as a tie.

After the point number is established, the craps numbers and 11 have no bearing on the outcome of the "pass" and "don't pass" wagers until after a 7 or the point number again is rolled. If a 7 is rolled, the pass line bets lose, the don't pass bets win, the shooter's turn is over, and the dice are given to another player to become the shooter. If the point number is repeated, the pass line bets win, the don't pass bets lose, and the shooter starts over with a new "come out roll."

In addition to making wagers in the PASS and DON'T PASS areas 23, 25, a player may also make similar wagers with respect to subsequent rolls of the dice, with essentially the same outcomes. These wagers are called "come" and "don't come" bets. The wagers are placed in a COME area 27 and a DON'T COME area 29.

After the point number is established on the "come out" roll or rolls, the players, including the shooter, may place wagers that another point number will be established and rolled again before the 7 is rolled by placing a wager within the "come" area 27. For example, after a first point number of 6 is established, the shooter's next roll is a second point number of 8. Then the shooter's following roll is another 8. Thus, the "come" wager wins. Also, until another point number is established, the "come" wager is a bet that the shooter will roll a natural before a point number or before Craps is rolled.

Also, after the first point number is established, the players may place wagers betting that another point number will be established but that the number 7 will be rolled before the point number is rolled again by placing a wager within the "don't come" area 29. Likewise, until another point number is established, the "don't come" wager is a bet that the shooter will roll craps before a point number or before a natural is rolled, except that a roll of 2 or 12, as predetermined by the host, is treated as a tie.

After a second point number is established, the Craps numbers and 11 have no bearing on the outcome of the "come" or "don't come" wagers made on prior rolls until a 7 or that point number again is rolled. If a 7 is rolled, the come bets lose and the don't come bets win. If the point number is repeated, the come bets win and the don't come bets lose. After the "come out" roll or rolls, "come" and "don't come" wagers may be made on every subsequent roll until the 7 or the initial point number again is rolled.

There are also a group of wagers in which the players may bet that the next roll or rolls of the dice will produce a certain number by the appearance of identical faces on each die ("doubles") before a 7 is rolled. Commonly called "hardway" bets, these wagers are also called proposition bets and are placed in area 31.

There are wagers in which players may bet that the numbers 6 or 8 will appear on the dice before the number 7 is rolled. These wagers are called the "Big 6" and the "Big 8" bets, respectively and are placed in areas 49 and 45, respectively.

The point numbers determined for the "come" and "don't come" wagers are monitored by placing "come" and "don't come" bets directly on areas 33, 35, 37, 39, 41, and 43, which are the point number boxes. Wagers called "place" bets that these numbers will appear on the dice before the number 7 is rolled also may be placed directly on the respective point number boxes. Wagers called "Lay" bets that these numbers will not appear on the dice before the number 7 is rolled also may be placed behind the respective point number boxes, in area 42.

The "Field" bet is also a single roll bet that one of a group of numbers will appear on the next roll of the dice. These wagers are placed in areas 47.

Although players may generally place as many bets or combinations of bets on any roll of the dice as they wish, the game of Craps as it is currently played does not offer the player a single bet which allows the player to receive a high-multiple payoff of the player's wager. The highest payoff of 30 to 1 on contemporary layouts are for the proposition bets that the next roll of the dice will total 2 or 12. Other than the proposition bets, the wagers available to players do not exceed a 2-to-1 payoff.

Figure 2:
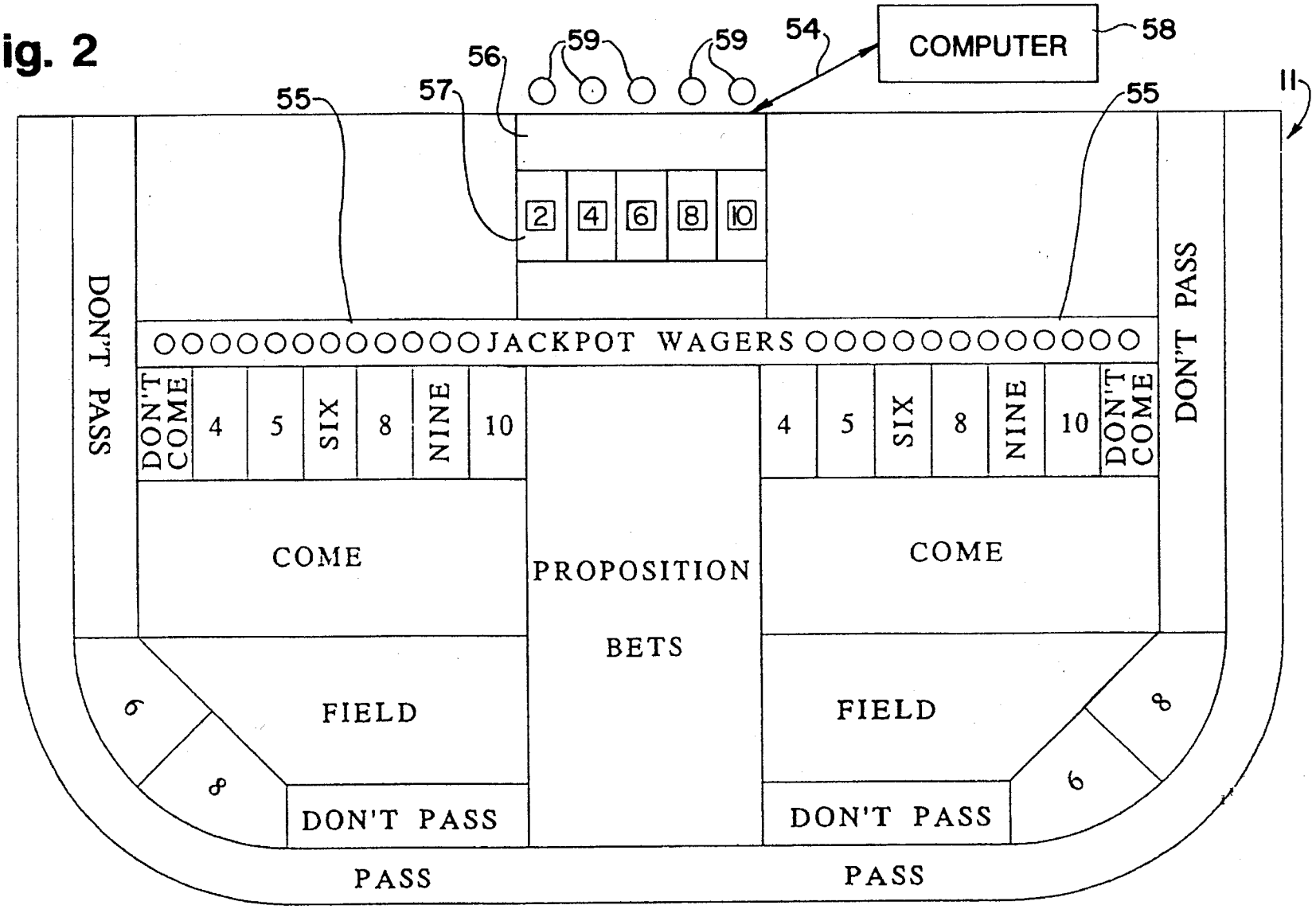
FIG. 2 is a top plan view of a second embodiment of a Craps gaming layout arrangement having a Craps jackpot wagering area and a mechanism for selecting a random set of numbers to be matched and a display for tallying the matches.

As shown in FIG. 1, a separate jackpot wagering area 51 is included for wagering on a particular jackpot possibility. The jackpot wagering area 51 is centrally located in FIG. 1 on the Craps layout 17, for example, "above" the PROPOSITION BETS area 31 in the central third of the layout. As will suggest itself, jackpot wagering area 51 may be positioned at a different location within the craps layout, as for example as shown in FIG. 2. The jackpot wagering area 51 is designated with a name or label 53 which indicates the nature of the wager. In FIG. 1, a title for the bet, BONANZA BET, is shown by label 53. Various other applicable titles may be used, such as "JACKPOT", "SUPER CRAPS JACKPOT", "BONANZA CRAPS", "BONUS BET", or "SWEEPSTAKES CRAPS."

Thus, the jackpot wager is won when the shooter matches the designated outcome on a series of rolls within a single turn of the shooter. The host may require that all matches must be completed within the shooter's turn, within a certain pre-defined number of rolls, or in a sequence of consecutive rolls with each roll matching the next number in the series.

The number of matches which the shooter must make is predefined by the host before the start of the shooter's turn. The greater the number of matches the host requires, the greater the odds against successfully completing the series and therefore the higher the payoff by the host for winning the jackpot.

As shown in FIG. 2, the series of events associated with the jackpot wagering area 55 is the roll of five matches. The series of numbers to be matched might be randomly generated via a mechanical control mechanism (not shown) and shown on display 57. The matches are tallied via markers 59 being used to cover each displayed number matched. Alternatively, the number of requisite matches might be greater than or less than five matches.

Figure 3:
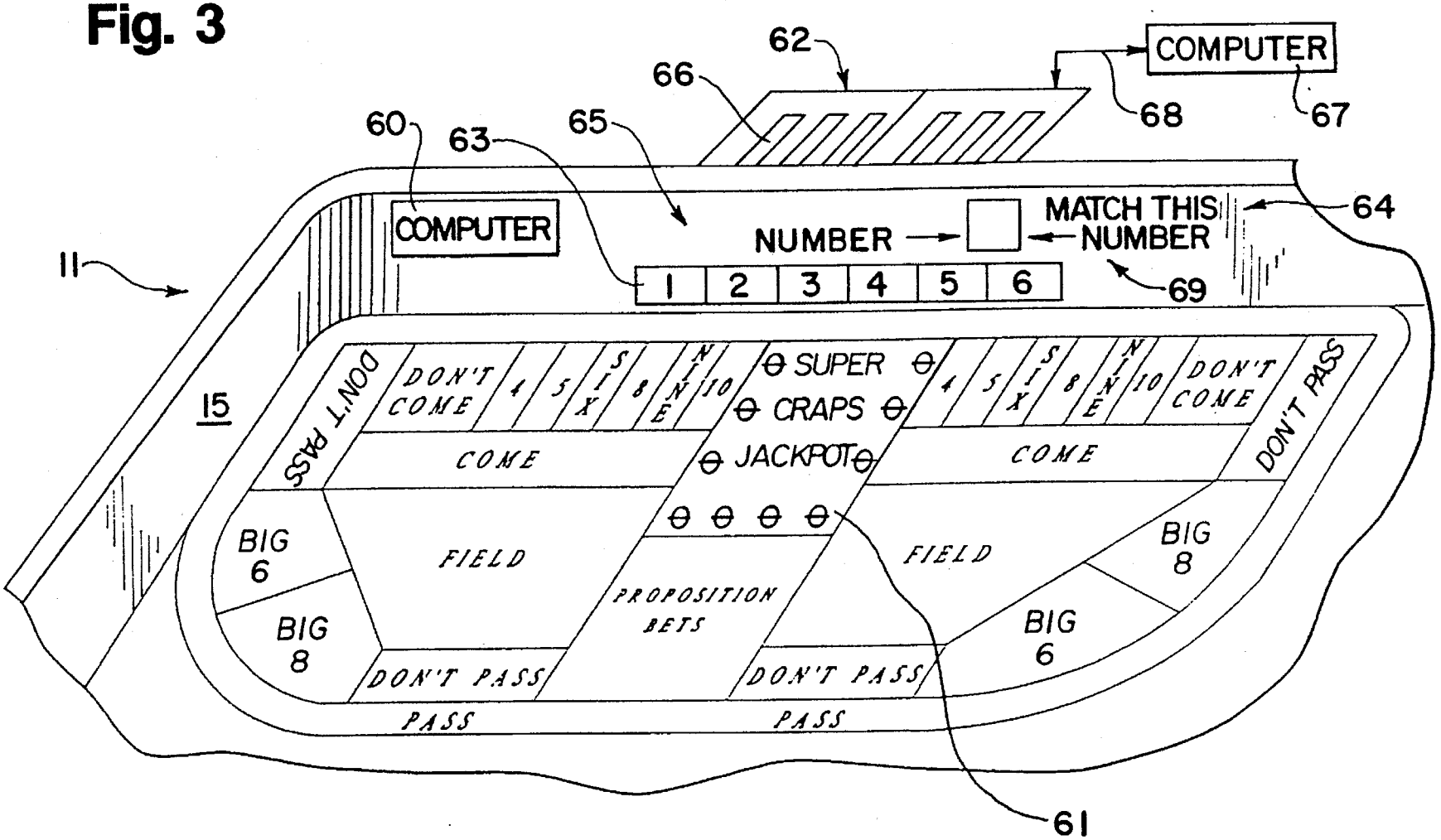
FIG. 3 is a perspective view of a third embodiment of a Craps gaming layout arrangement having a Craps jackpot wagering area and a mechanism for selecting a random set of numbers to be matched and a display for tallying the matches.

As shown in FIG. 3, the series of events associated with the jackpot wagering area 61 is the roll of six matches. The numbers to be matched might be randomly generated either individually or as a complete series via control mechanism 62 and shown on display 64. The matches are tallied and shown on display 63. Alternatively, the number of requisite matches might be greater than or less than six matches.

Figure 4:
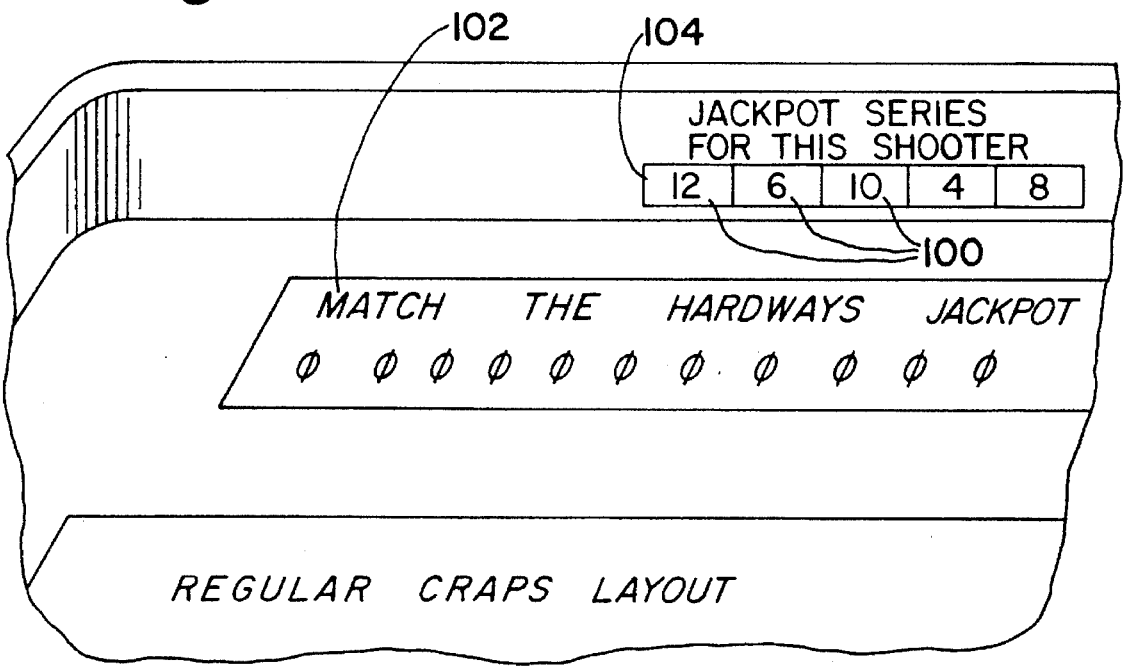
FIG. 4 is a perspective view of a fourth embodiment of a Craps gaming layout arrangement having a Craps jackpot wagering area and a mechanism for selecting a random set of numbers to be matched and a display for tallying the matches.

As shown in FIG. 4, the series of events associated with the jackpot wagering area 102 is the roll of five matches. A match occurs when the shooter matches the hardway numbers as shown on display 104. This sequence (e.g. 12-6-10-4-8 as shown) would be randomly generated. As each hardway number in the jackpot sequence is matched, the corresponding individual indicator 100 would light up to show the shooter's progression towards completing the jackpot sequence. Alternatively, the number of requisite matches might be greater than or less than five matches.

Figure 5:
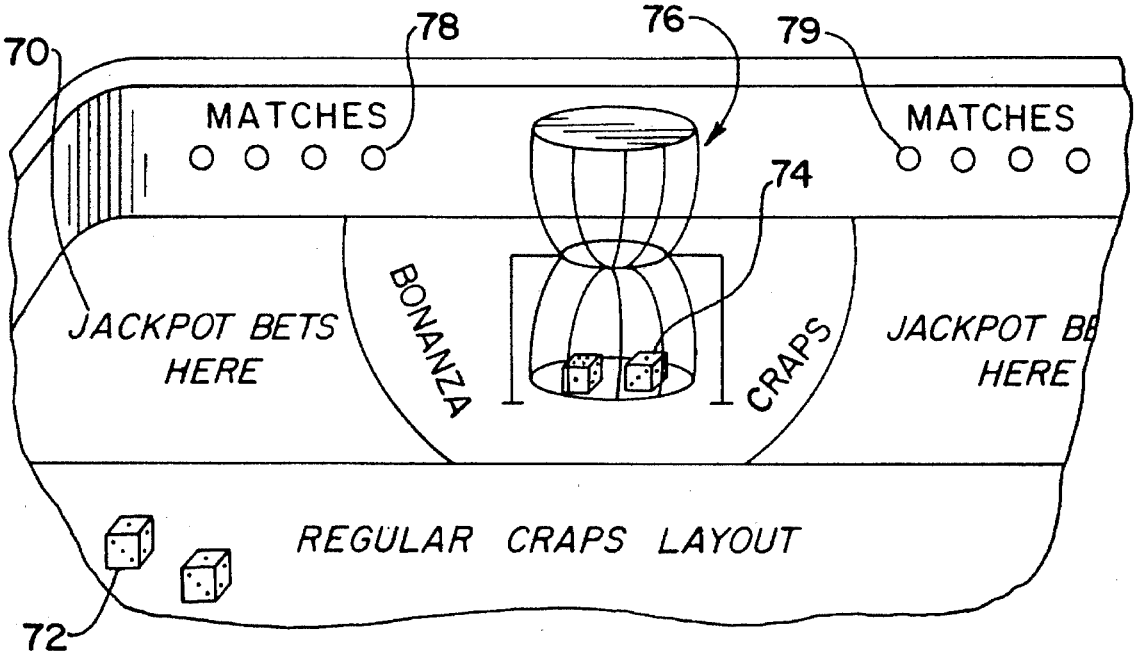
FIG. 5 is a perspective view of a fifth embodiment of a Craps gaming layout arrangement having a Craps jackpot wagering area and a caged-dice mechanism for selecting random numbers to be matched and display for tallying the matches.

As shown in FIG. 5, the series of events associated with the jackpot wagering area 70 is the roll of 4 matches. A match occurs when the shooter's dice 72 matches the dice 74 disposed in the cage apparatus. Matches are tallied and shown on displays 78, 79. Alternatively, the number of requisite matches might be greater than or less than four matches.

Figure 6:
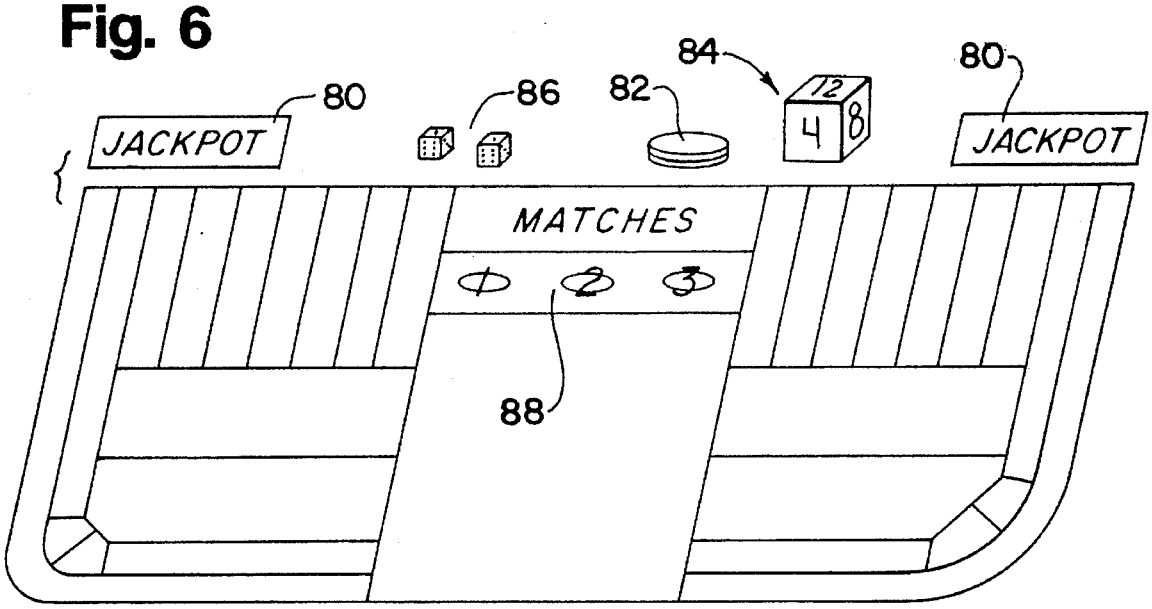
FIG. 6 is a perspective view of a sixth embodiment of a Craps gaming layout arrangement having a Craps jackpot wagering area and a die for selecting random numbers to be matched and marker for tallying the matches.
Figure 6A:
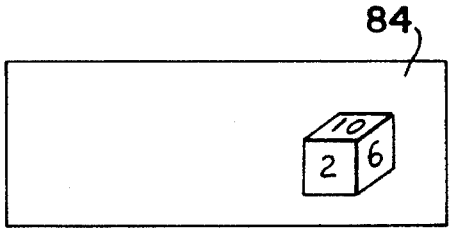

As shown in FIG. 6, the series of events associated with the jackpot wagering area 80 is the roll of three matches. In this particular arrangement, the shooter dice 86 are required to match the number displayed on a cube 84, which can be rolled by the shooter or by the host before the beginning of the shooter's turn. A marker (or puck) 82 is used to tally the number of matches on display area 88. Alternatively, the number of requisite matches might be greater than or less than three matches.

Figure 7:
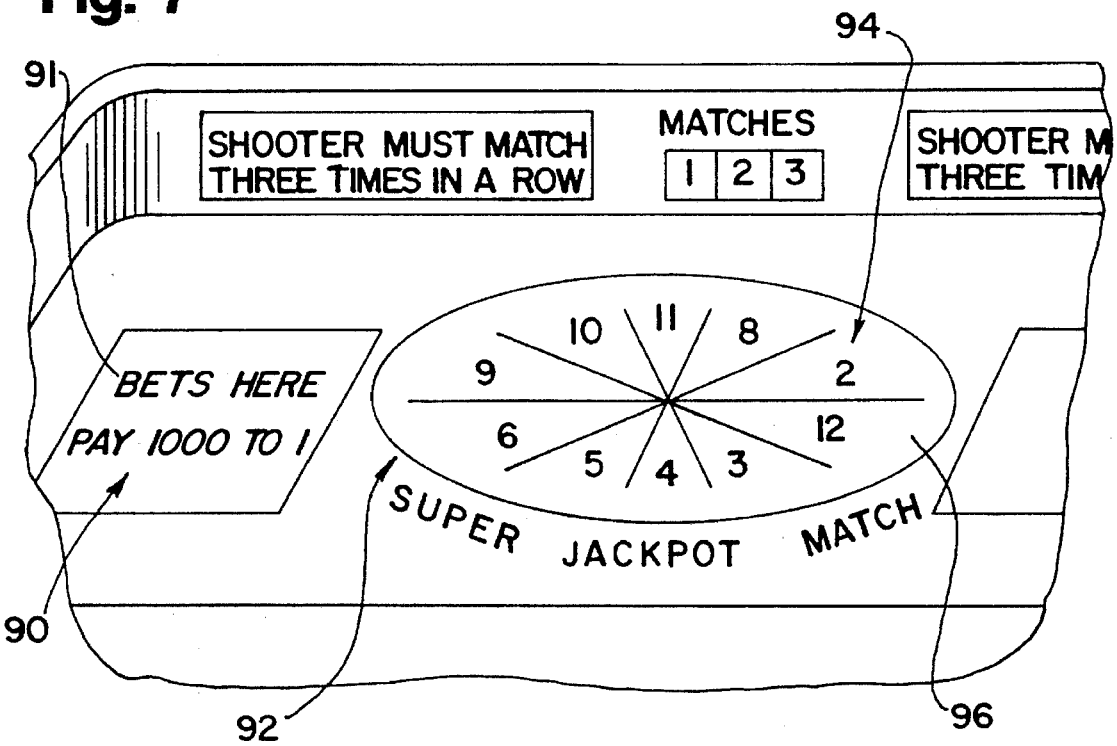
FIG. 7 is a perspective view of a seventh embodiment of a Craps gaming layout arrangement having a Craps jackpot wagering area and a segmented wheel for selecting random numbers to be matched and a display for tallying the matches.

As shown in FIG. 7, the series of events associated with the jackpot wagering area 90 is the roll of three matches. In this figure, a rotatable wheel 92 with pie-shaped regions 94 designating a different potential outcome is employed to determine the match number. Again, either the shooter or the host may activate the rotatable wheel by applying pressure from a hand thereby spinning the wheel. The match number is displayed by the alignment between a number on the wheel and an indication device 96, shown as a black dot located outside the numbers on the wheel in FIG. 7. Indication device 96 might be, for example, a pointer or a rolling ball. Alternatively, the number of requisite matches might be greater than or less than three matches.

The designated outcomes which the host may select constitute a finite set of dice outcomes. The host may select all possible outcomes from a pair of dice, which are eleven, to be included in the set of designated outcomes which must be matched or the host may select only a subset of the possible outcomes. The host may require the series to be completed before a turn-ending 7 is rolled or may require, or allow, the final match in the series to be a 7. The host also may allow the same number from the finite set of dice outcomes to be repeated any number of times in the series or may permit each number or outcome in the finite set to be designated only once. Additionally, the host may require the series to be rolled in a particular progression, or sequence, in order to win the jackpot.

The host may also define the number of matches to be equal to the number of outcomes in the finite set and designate each outcome only once, so that the set of outcomes will be exhausted in order to win the jackpot. The possible set which the host may select for designation in the sequence constitutes any two or more of the eleven possible dice outcomes. The designated set from which the sequence is to be selected may be any series of numbers arbitrarily determined by the host, such as (2, 5, 8, 9, and 12). As shown in FIGS. 2, 4, and 6, a set of numbers readily understood by the shooter, such as the hardways (2, 4, 6, 8, 10, and 12) might be selected by the host. Additionally, such known sets as "the field" (2, 3, 4, 9, 10, 11, and 12), or "craps and the naturals" (2, 3, 7, 11, and 12) might be used.

The host establishes the time at which bets may be placed, but typically the bet is required to be placed before the first outcome roll which begins the series leading to the jackpot. The host must also keep track of which players make wager in the jackpot area 51 (FIG. 1 ). In addition, the host sets the minimum and maximum bet permitted for jackpot area 51.

A player makes a jackpot bet as follows. On the first come out roll of the shooter, a player will make a wager. For example, in FIG. 7, a player will place a $1.00 chip in jackpot area 90. Visual indicia 91 is printed in area 90 to indicate that the jackpot pays, for instance, 1,000-to-1. Thus, a bet of $10.00 will yield $10,000 on a jackpot win in this example.

Also, rather than indicia 91 stating the wager odds of "1,000-to-1", indicia 91 might state a fixed dollar amount payoff, for example, $20,000. In such a case, all players who wager in the jackpot area will each share in a single jackpot amount.

Alternatively, the jackpot may be a progressive jackpot, i.e., a jackpot which starts at a minimum dollar amount and is progressively increased. The pot is increased by a percentage of the wagers lost in the jackpot area. The host will set the proportionate increase of the jackpot for wagers placed. For example, the host could establish that the jackpot increases 50 cents for each dollar wagered and lost in the jackpot area.

The host may calculate the progressive jackpot based upon wagers made at a single table or based upon wagers made at a group of tables in which craps games are being simultaneously played. A jackpot winner at one table might serve to reset the jackpot value to its minimum at all tables in the group.

The host may make the jackpot easier or more difficult to achieve by varying the definition of the qualifying series of required outcomes. For example, three doubles/hardways in a row is easier to win than four doubles/hardways in a row. The payoff may also be varied according to the difficulty of achieving the defined series of sequence. For example, instead of paying 6000-to-1, an easier series may pay 4000-to-1.

The host of the game may require the completion of the series before any seven is rolled, including come out rolls, in order to qualify for a jackpot payoff. In addition, the host may require that the series be completed before the shooter does not pass, but not counting any come out roll either for or against satisfaction of the requirement for winning the jackpot. This requires the shooter to make the specific outcome rolls of the jackpot within the shooter's turn at rolling the dice.

The host may decide when the jackpot wager is lost. For example, the host may simply require that each roll after a bet is made must match a designated outcome or the bet is lost. Alternatively, if the shooter does not complete the series before the end of the shooter's turn, i.e., does not pass, the bet is lost. The bet also may be lost when a consecutive sequence in a series is not completed in the proper order, once the sequence has started. The host may allow the shooter a fixed number of rolls to match each number in the sequence or to complete the sequence or the bet is lost. All variations are subject to the limitation that the series must be completed within the shooter's turn or the bet is lost. In addition, a timer (not shown) may be set to provide a period of time within which the jackpot conditions must be met; at the end of the timer period, the bet is lost.

The host will also set the value of the high-multiple payoff for the jackpot wager. The payoff could be a fixed payoff at some rate less than the true odds of the series of events selected by the host to define how the jackpot may be won, such as 1,000-to-1 or 5,000-to-1. The payoff may also be defined as a progressive jackpot consistent with the manner in which progressive jackpots are currently computed within the gambling entertainment industry. Since a large number of players may be placing the jackpot wager on any shooter, the precise payoff for each player might not be predetermined, since each player with a wager would receive a pro-rated share of the progressive jackpot. The host might set a minimum payoff for any winning jackpot wager.

The additional wagering and potential jackpot payout adds an enhanced level of excitement to the craps gaming table without destroying or changing the atmosphere of the game. A shooter, and other players, can place wagers based on several different type of options, these options are determined by the host. This type of arrangement allows the host to dictate the specific series required to win the jackpot. The introduction of a random selection mechanism or device to determine the required jackpot series can further enhance the level of excitement without changing the atmosphere of the game.

Referring again to FIG. 2, the host may employ either a computer program or a physical/mechanical mechanism to designate the series or outcomes which the shooter must match in order to qualify for a jackpot. If a computer program is utilized by the host, the computer 56 and program might reside in gaming structure 11. Alternatively, access might be established, via a link 54 (e.g., cable, wire, radio frequency, infrared), between an external computer 58 and gaming structure 11.

Similarly, as shown in FIG. 3, a control mechanism 62, shown as a series of buttons 66, can be employed to provide the host the ability to interact with a computer 60, as located in gaming structure 11. Alternatively, the host might interact with a computer 67 as connect by link 68. A computer might similarly be used on all other game variations which lend themselves to use of electronic or electro-mechanical generation of numbers to be matched.

As shown in FIGS. 5, 6, and 7, physical devices may be used to designate the outcomes which must be matched. In FIG. 5, the pair of dice 74 in the cage apparatus 76 are rolled by spinning the cage to designate the outcome which the shooter must match. FIG. 6 shows a cube 84 with six possible outcomes that the shooter must match in the next roll(s). In FIG. 7, the wheel 92 could be either a mechanical device or a visual representation by lights of the results of a computer program selection. Each of the physical devices used to determine the outcome to be matched can be operated by the host or by the patron (presumably the shooter) thereby involving the patron in the designation of the outcome.

The selection mechanism, either the computer program or the physical devices, used by the host to designate outcomes may be either a true random selection process or a weighted probability process which could be inherent in the mechanism selected or else programmed into the system. For example, if the finite set of potential designated outcomes were all of the possible outcomes of a dice roll, then the host could use a variety of methods to designate the outcome for any given roll of the dice.

For instance, the host might use an actual pair of dice, such as in FIG. 5, in which case the probability that the number to be matched is a 6 would be 5/36, which is equal to the probability inherent in a pair of unbiased dice being rolled. If an unbiased roulette-like wheel 92, as shown in FIG. 7, were used to designate the outcome to be matched, each number on the wheel 92 could be equally weighted so that the likelihood of any number being selected would be 1/11.

Alternatively, if a computer program were utilized, the host could use a random number selection program which could simulate either the natural probabilities of occurrence found in dice, the equal probabilities of each outcome like that of an unbiased wheel, or some other probability distribution. An example of a weighted probability system would be where the selection mechanism selected only numbers other than 7 to be matched, so that the probability that the number to be matched is a 6 would be 5/30, or simply 1/6.

The invention also includes at least two visual displays for the shooter and other players placing bets. The first display shows the outcome designated by the selection mechanism and allows the shooter and other betters to know before the roll what outcome must be matched. This display is inherent on a mechanical or physical process as shown in FIGS. 2–8. If a computer program is used, visual representation must be shown on a screen or light display 64 for the shooter and other betters to see, as shown in FIG. 3. If a mechanical device is used, as in FIGS. 5–7, the device itself (e.g., die and wheel faces) generally serves to display the generated number.

The second display is used to show the shooters progress in matching the designated outcomes. FIGS. 2–8 illustrate different ways this could be done. The host of the game may supervise the operation of the second display via a control board 62 (FIG. 3). In addition, either lights or pucks or other indicia may be employed.

For example, in FIG. 3, the display has visual indicia 63 which show how far the shooter has progressed in matching the entire series. There may be more than one visual display, such as one for each side of the table (FIG. 5). In addition, in FIG. 2, an area 57 near jackpot wagering areas 55 may be provided for locating markers 59 and from which individual markers 59 are moved to cover individual visual indicia in areas 57. The visual indicia might be randomly generated by the computer program (2, 4, 6, 8, and 10) in this example.

Figure 8:
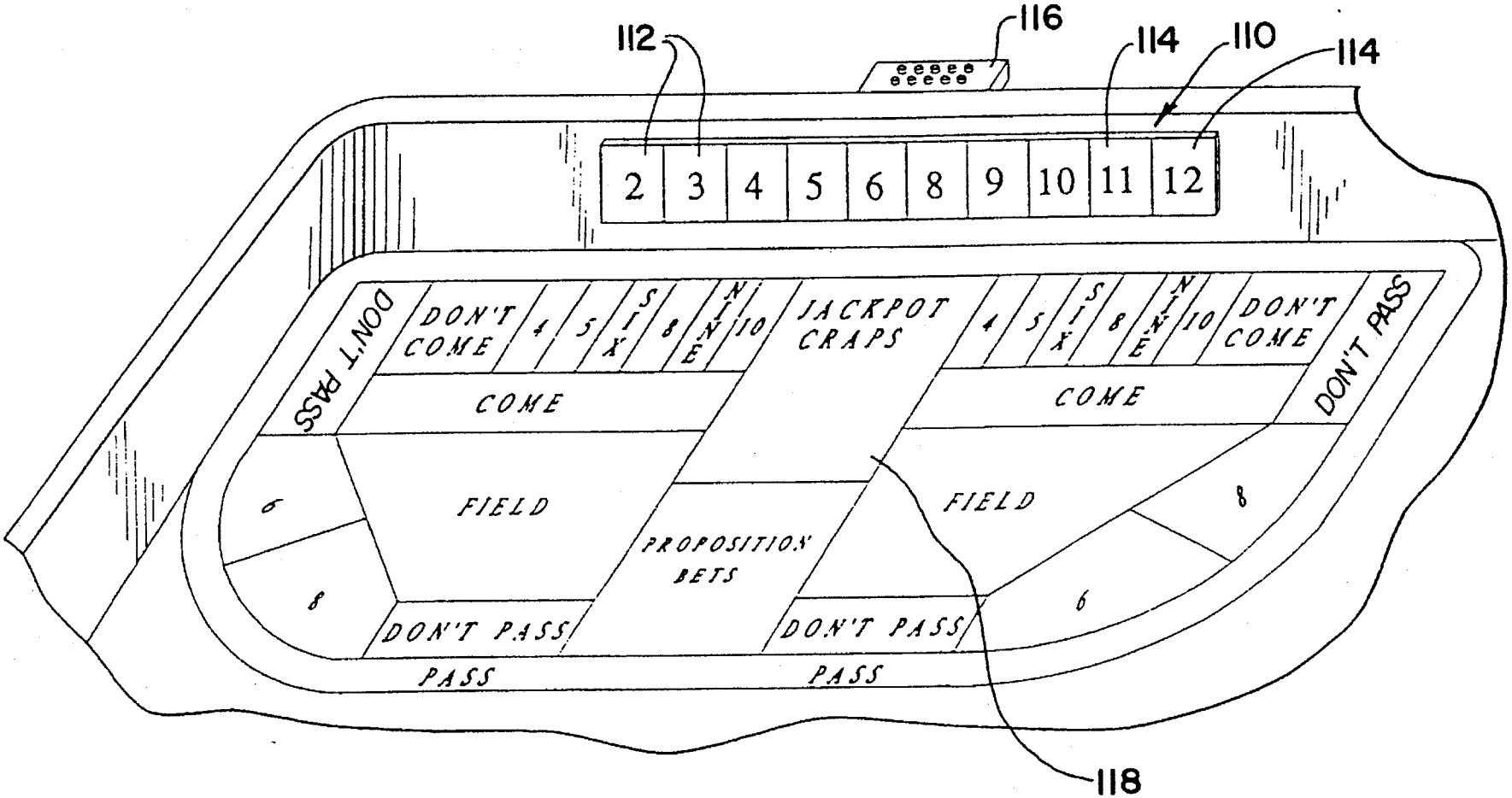
FIG. 8 is a perspective view of an eighth embodiment of a Craps gaming layout arrangement having a Craps jackpot wagering area and a mechanism for selecting and for displaying random numbers to be matched.

Referring to FIG. 8, the craps layout includes a jackpot wagering area 118 and display area 110. Display area 110 includes ten separately lightable frames 112. Frames 112 are translucent, light permeable, square plates with an indicia 114 located in each frame 112. Frames may be controlled (lighted), by the host, to indicate the required series which is determined randomly and explained previously. Once one of the numbers required for the jackpot is rolled by the shooter, the host further activates the frame by using the control board 116 and control switches. Frame 112, to indicate that a number has been rolled in the series, may flash or change the color of the light to visually display the progress of the shooter toward completion of the required series.

Referring again to FIG. 3, a display area 69 is comprised of six separate visual indicia 63 for displaying the progress of the dice roller in completing the required series of rolls in order to win the jackpot. In FIG. 3, there are six such indicia 63 because, in this case, the random selection mechanism (computer program) has defined the jackpot as a series of six matching rolls. The actual number of displays and indicia are a function of the manner in which the host has defined the jackpot sequence. For example, in FIG. 8, ten displays and indicia are used, as described above.

As shown in FIG. 3, the display area 69 is immediately adjacent to the jackpot wager area 61 on the Craps layout. The display 64 is located above the six visual indicia 63 which comprise the six numbers 1, 2, 3, 4, 5, and 6. Each indicia 63 is actuatable to occupy one of two states, ON or OFF, which consists of a visual change by lighting, for example, the indicia 63 with light. Indicia 63 is turned ON when the required outcome, as indicated in display 64 has been met the appropriate number of times, i.e. , the number of times the display number has been rolled by the shooter. This provides a visual disclosure to the players of the closeness of the shooter in making the jackpot requirements. In the alternative, the display area 69 may show the numbers and sums of numbers to be rolled for a payoff and indicate which numbers are to be rolled or have been rolled by a different type of indicator light. The lights may be light bulbs (not shown) with the numbers or sums of numbers appearing on the bulbs themselves. The light bulbs may also be located immediately above, below, or beside the numbers or sums of numbers. Alternatively, the lights may be in the shape of the numbers to be rolled. The lights may be mined 0N continuously or flashed to indicate an ON condition. As the dice roller rolls a particular number or sum of numbers, the light bulbs may progressively be mined OFF or ON, so that the displays 63 report on the progress of the dice roller toward meeting the jackpot requirements.

Alternatively, the display area 69 may be located in a separate part of the layout. Alternatively, the display area 69 may be separated from the layout in a form by which the progress of the dice roller is visually disclosed to the players. The display area 69 may chart the progress of the dice roller by showing all of the necessary numbers or sums of numbers which must be rolled in the jackpot series and indicating the progress of the dice roller in achieving the roll of those numbers or groups of numbers. The display area 69 may either indicate which numbers or sums of numbers have already been rolled or which numbers or sums of numbers remain to be rolled.

Referring again to FIG. 3, the control board 62 is secured to side wall 15 and comprises six separate switches 66 which are manually actuatable to light (or turn ON) a respective display. While only a single, preferred embodiment of the invention has been described hereinabove, those of ordinary skill in the art will recognize that the embodiment may be modified and altered without departing from the central spirit and scope of the invention. Thus, the preferred embodiment described hereinabove is to be considered in all respects as illustrative and not restrictive, the scope of the invention being indicated by the appended claims, rather than by the foregoing description, and all changes which come within the meaning and range of equivalency of the claims are intended to be embraced herein.

I claim:

1. An amusement device including:

a pair of dice each having six faces bearing a visual representation of the numbers one through six, said dice being of a size for manually rolling to present one of eleven different numbers which define a plurality of point numbers, at least one natural number, and at least one craps number;

a gaming layout to provide a flat surface upon which said dice may be rolled and upon which bets may be laid by physical placement of wagers, said flat surface including indicia thereon representing a plurality of wager areas, said wager areas including:

(a) a pass line area for receiving a wager betting both (i) that one or more rolls of dice will yield an established first point number without rolling the number "7"; and (ii) that a natural number is rolled prior to establishing the first point number or prior to rolling a craps number;

(b) a don't pass area for receiving a wager betting both (i) that one or more rolls of the dice will yield the number "7" prior to the rolling of an established first point number; and (ii) that a craps number is rolled prior to establishing the first point number or prior to rolling a natural number; and (c) a jackpot area for receiving a wager that a set of a plurality of dice outcomes are rolled, said set having a remote probability of occurrence, and said set being randomly generated at a certain point in the play.

2. An amusement device including:

a pair of dice each having six faces bearing a visual representation of the numbers one through six, said dice being of a size for manually rolling to present one of eleven different numbers which define a plurality of point numbers, at least one natural number, and at least one craps number;

a gaming layout to provide a flat surface upon which said dice may be rolled and upon which bets may be laid by physical placement of wagers, said flat surface including indicia thereon representing a plurality of wager areas, said wager areas including:

(a) a pass line area .for receiving a wager betting both (i) that one or more rolls of dice will yield an established first point number without rolling the number "7"; and (ii) that a natural number is rolled prior to establishing the first point number or prior to rolling a craps number;

(b) a don't pass area for receiving a wager betting both (i) that one or more rolls of the dice will yield the number "7" prior to the rolling of an established first point number; and (ii) that a craps number is rolled prior to establishing the first point number or prior to rolling a natural number;

(c) a jackpot area for receiving a wager that a set of a plurality of dice outcomes are rolled, said set having a remote probability of occurrence; and (d) random generation means for randomly generating said dset of plurality of dice outcomes.

3. An amusement device according to claim 2 wherein said random generation means includes user-interactive computer controlled circuitry for random generation of said set of dice outcomes.

4. An amusement device according to claim 2 and further including a jackpot display selectively actuatable to provide a visual indication of dice outcomes of said set.

5. An amusement device according to claim 4 wherein said jackpot display includes a plurality of separate indicators, each of said indicator indicating one of said dice outcomes of said set.

6. An amusement device according to claim 5 wherein each of said indicators has an ON condition and an OFF condition.

7. An amusement device according to claim 2 wherein said jackpot area includes visual indicia indicating said set of dice outcomes.

8. An amusement device according to claim 2 wherein said jackpot area is available to all players for wagers.

9. An amusement device according to claim 2 and further including a jackpot which is shared among all players wagering in said jackpot area.

10. An amusement device according to claim 2 wherein said jackpot display area includes means for displaying the progress made toward winning said jackpot.

11. An amusement device according to claim 10 wherein said means for displaying said progress comprises a marker, and separate indicia of each one of said outcomes, said marker useable to mark one of said indicia.

12. An amusement device according to claim 10 wherein said means for displaying said progress includes a lighting mechanism for separately indicating each one of said dice outcomes.

13. An amusement device according to claim 12 wherein said means for displaying said progress includes separate indicia of each one of said outcomes, said lighting mechanism separately highlighting each of said separate indicia.

14. An amusement device according to claim 2 wherein said series of dice outcomes comprises a plurality of consecutive, equivalent dice outcomes of any one of the numbers 2, 3, 4, 5, 6, 8, 9, 10, 11, or 12, or a subset of these numbers, followed by a 7.

15. An amusement device according to claim 2 wherein said series of dice outcomes comprises consecutive dice outcomes of numbers in a sequence generated by said random generation means from a predefined set of a limited number of possible outcomes, followed by a 7.

16. An amusement device according to claim 2 wherein said series of dice outcomes comprises a plurality of consecutive dice outcomes of any one of the numbers 2, 4, 6, 8, 10, or 12, or a subset of these numbers, followed by a 7, wherein the dice outcomes for the numbers 2, 4, 6, 8, 10, and 12 are a pair of identical outcomes on each die.

17. An amusement device according to claim 2 wherein said series of dice outcomes comprises dice outcomes of any of the numbers 2, 4, 6, 8, 10, and 12, or a subset of these numbers, in any order, followed by a 7, wherein the dice outcomes for the numbers 2, 4, 6, 8, 10, and 12 are a pair of identical outcomes on each die.

18. An amusement device according to claim 2 wherein said series of dice outcomes comprises dice outcomes of any of the numbers 2, 3, 4, 5, 6, 8, 9, 10, 11, and 12, or a subset of these numbers, in any order, followed by a 7.

19. An amusement device according to claim 2 wherein said series of dice outcomes comprises a plurality of consecutive, equivalent dice outcomes of any one of the numbers 2, 3, 4, 5, 6, 8, 9, 10, 11, or 12, or a subset of those numbers, before a 7 is rolled.

20. An amusement device according to claim 2 wherein said series of dice outcomes comprises consecutive dice outcomes of numbers in a sequence generated by said random generation means from a predefined set of a limited number of possible outcomes, before a 7 is rolled.

21. An amusement device according to claim 2 wherein said series of dice outcomes comprises a plurality of consecutive dice outcomes of any one of the numbers 2, 4, 6, 8, 10, or 12, before a 7 is rolled, wherein the dice outcomes for the numbers 2, 4, 6, 8, 10, and 12 are a pair of identical outcomes on each die.

22. An amusement device according to claim 2 wherein said series of dice outcomes comprises dice outcomes of the numbers 2, 4, 6, 8, 10, and 12, before a 7 is rolled, wherein the dice outcomes for the numbers 2, 4, 6, 8, 10, and 12 are a pair of identical outcomes on each die.

23. An amusement device according to claim 2 wherein said series of dice outcomes comprises dice outcomes of the numbers 2, 3, 4, 5, 6, 8, 9, 10, 11, and 12, or a subset of these numbers, in any order, before a 7 is rolled.

24. An amusement device according to claim 2 wherein said series of dice outcomes comprises a plurality of consecutive dice outcomes of the number 7.

25. An amusement device according to claim 2 wherein said series of dice outcomes comprises a plurality of consecutive dice outcomes of the natural numbers 7 and 11, in any order.

26. An amusement device according to claim 2 wherein said series of dice outcomes comprises a plurality of consecutive dice outcomes of the craps numbers 2, 3, and 12, in any order.

27. An amusement device according to claim 2 wherein said series of dice outcomes comprises a plurality of consecutive dice outcomes of the craps numbers 2, 3, and 12, followed by a 7.

28. An amusement device according to claim 2 wherein said series of dice outcomes comprises a plurality of dice outcomes of the field numbers (2, 3, 4, 9, 10, 11 and 12) before a 7 is rolled.

29. An amusement device according to claim 2 wherein said series of dice outcomes comprises a plurality of dice outcomes of the field numbers (2, 3, 4, 9, 10, 11 and 12), followed by a 7.

30. An amusement device according to claim 2 wherein said series of dice outcomes comprises consecutive dice outcomes of numbers in a sequence which is partially pre-defined and partially generated by said random generation means from a predefined set of a limited number of possible outcomes, followed by a 7.

31. An amusement device according to claim 2 wherein said series of dice outcomes comprises dice outcomes of numbers, in any order, in a sequence which is partially pre-defined and partially generated by said random generation means from a predefined set of a limited number of possible outcomes, followed by a 7.

32. An amusement device according to claim 2 wherein said series of dice outcomes comprises consecutive dice outcomes of numbers in a sequence which is partially pre-defined and partially generated by said random generation means from a predefined set of a limited number of possible outcomes, before a 7 is rolled.

33. An amusement device according to claim 2 wherein said series of dice outcomes comprises dice outcomes, in any order, of numbers in a sequence which is partially pre-defined and partially generated by said random generation means from a predefined set of a limited number of possible outcomes, before a 7 is rolled.

34. An amusement device according to claim 2 wherein said random generation means randomly selects a plurality of dice outcomes from a predefined set of possible outcomes.

35. A gaming layout having wagering possibilities, said layout comprising:

a flat surface having game indicia thereon corresponding to a craps game having said wagering possibilities;

a pair of dice;

a wagering area for wagering on said wagering possibilities, said wagering possibilities corresponding to low payoffs;

a jackpot wagering area for providing a jackpot corresponding to a high payoff when a series of dice outcomes are made;

a random generation means for randomly generating said series of dice outcomes which define said jackpot;

a jackpot display area, said jackpot display area displaying said series of dice outcomes which define said jackpot; and a display area displaying a player's progress towards achieving the defined jackpot sequence.

36. A gaming layout according to claim 35 wherein said random generation means includes user-interactive computer controlled circuitry for random generation of said set of dice outcomes.

37. A gaming layout according to claim 35 wherein said series of dice outcomes comprises consecutive dice outcomes of numbers in a sequence which is partially predefined and partially generated by said random generation means from a predefined set of a limited number of possible outcomes, followed by a 7.

38. A gaming layout according to claim 35 wherein said series of dice outcomes comprises dice outcomes, in any order, of numbers in a sequence which is partially predefined and partially generated by said random generation means from a predefined set of a limited number of possible outcomes, followed by a 7.

39. A gaming layout according to claim 35 wherein said series of dice outcomes comprises consecutive dice outcomes of numbers in a sequence which is partially predefined and partially generated by said random generation means from a predefined set of a limited number of possible outcomes, before a 7 is rolled.

40. A gaming layout according to claim 35 wherein said series of dice outcomes comprises dice outcomes, in any order, of numbers in a sequence which is partially predefined and partially generated by said random generation means from a predefined set of a limited number of possible outcomes, before a 7 is rolled.

41. A method for wagering using the gaming layout according to claim 35 wherein said method comprises:

randomly generating said series of dice outcomes for said jackpot wagering area;

displaying said series of dice outcomes;

placing and receiving said wagers on said wagering areas, including said jackpot wagering area;

repeatedly rolling said pair of dice as per craps gaming rules;

tallying and displaying each occurrence of said series of dice outcomes as they are rolled;

continuing towards completing said jackpot series within a host defined series of rolls, until the jackpot series is completed and the jackpot wagerers win, or the host defined series of rolls is completed and the jackpot wagerers lose.

42. A method for wagering according to claim 41 wherein said random generation means includes user-interactive computer controlled circuitry for random generation of said set of dice outcomes.

* * * * *